United States Patent [19]

Fegley

[11] 4,018,361

[45] Apr. 19, 1977

[54] FLUID DISPENSING ANTI-BURGLAR DEVICE

[76] Inventor: Charles R. Fegley, 1606 Frush Valley Road, Laureldale, Pa. 19605

[22] Filed: Feb. 17, 1976

[21] Appl. No.: 658,714

[52] U.S. Cl. ..... 222/5; 109/33; 222/162; 222/325

[51] Int. Cl.² ..... F17C 13/08

[58] Field of Search ..... 222/83.5, 82, 5, 3, 222/162, 320, 325, 336; 169/57, 60, 61, 26, 42; 292/DIG. 66; 109/20, 33, 29; 9/316–320

[56] References Cited

UNITED STATES PATENTS

| | | | |
|---|---|---|---|
| 3,209,937 | 10/1965 | Hirst et al. | 169/26 |
| 3,536,139 | 10/1970 | Berti et al. | 169/26 |
| 3,967,757 | 7/1976 | Fegley | 222/83.5 X |

*Primary Examiner*—Robert B. Reeves
*Assistant Examiner*—John P. Shannon

[57] ABSTRACT

A fluid dispensing anti-burglary device is disclosed in which a fluid, containing a chemical such as tear gas, is discharged into an area to be protected when an intruder forces entry into the area with which the device is associated. The anti-burglar device employs an electrothermal actuator as a trigger for releasing a spring biased member to cause the discharge of fluid from a pressurized container.

14 Claims, 15 Drawing Figures

FLUID DISPENSING ANTI-BURGLAR DEVICE

BACKGROUND OF THE INVENTION

The invention relates generally to an anti-burglary device of the chemical weapon type and more particularly to an anti-burglary device which discharges a fluid, containing a chemical such as tear gas, from a pressurized container into the protected area upon actuation by an unauthorized person. Once actuated, the protected area is flooded with the chemical, thereby forcing evacuation of the protected area by the intruder.

Chemical weapons have been known in the art for many years. One type of chemical weapon is the conventional tear gas grenade which is manually triggered and manually hurled at a target area, causing the target area to be flooded with the chemical irritant.

In another type of chemical weapon, the chemical irritant is stored under pressure in an aerosol type container. The actuating member is again manually triggered and the chemical irritant in the form of a spray is manually directed at the target.

A third type of chemical anti-burglar device discharges an explosive tear gas shell into the area but this type is both dangerous and very limited as to the amount to tear gas which is discharged into the area to be protected.

A fourth type of anti-burglary device is of the booby trap type in which a pressurized container releases its chemical contents into an area to be protected. This type of device is presently actuated mechanically by physical force or electrically by an electromechanical actuator controlling a trigger. The electrically operated anti-burglary device requires the use of a trigger and an electromechanical actuator to control the trigger. This device is complex and requires relatively large amounts of electric power for release.

Thus what is needed is an anti-burglary device in the form of a fluid dispenser which can be discharged by a relatively small amount of electric power. In addition, through the use of less complex parts and fewer parts, a less costly device can be manufactured while improving its reliability.

SUMMARY OF THE INVENTION

The principle object of the present invention is to provide an anti-burglary device of the fluid dispensing type which can be reliably actuated by a very small amount of electric power, yet is mechanically secured against accidental release, through the use of an electrothermal actuator. The electrothermal actuator is comprised of a bimetal strip and a heating element in which the bimetal strip is made of materials having disimilar coefficients of expansion. The bimetal strip is arranged to bend and permit fluid discharge when heated.

A further object of the invention is to provide an anti-burglary device of the chemical weapon type which is readily triggered by a small amount of electric power when an intruder triggers a switch with which the device is connected.

Another object of the invention is to provide an improved means of dispensing fluid into a protected area in a minimum amount of time in order to force an intruder from the protected area and to prevent the intruder from re-entering the area for a reasonable amount of time.

A further object of this invention is to provide an anti-burglary device having means for reloading the device and resetting the trigger after the device has been discharged.

Another object of the present invention is to provide a directable discharge of the fluid, such as by means of a rotatably adjustable dispensing head, so that the device can be located on a door, wall, or the like, and yet, when the device is actuated, the fluid is directed into the area to be protected.

According to the principle aspect of the present invention there is provided an improved means for releasably retaining spring biased elements in a cocked position. Such means includes an electrothermal actuator adapted to be movably mounted between an actuation position and a release position. The electrothermal actuator is electrically connected to a switch which may be associated with a door, window or an object which might be moved by an intruder entering a room or building or other area from which it is desired to restrict unauthorized persons. When the electrothermal actuator is in its actuation position, it retains the spring biased elements in their cocked position. When the intruder trips the switch, electric power applied to the electrothermal actuator causes the electrothermal actuator to heat. The heat causes the electrothermal actuator to bend and move from engagement with the spring biased elements to a release position, thereby permitting the spring biased elements to cause fluid to be discharged from the pressurized container into the protected area.

The anti-burglary device of the present invention may be utilized in homes, factories, farms or office buildings and may also be used in connection with vehicles such as boats, trucks, airplanes, etc. The device may also be employed for any other application wherein it is desired to prevent unauthorized persons from moving certain objects by placing the mounted device against the object.

Once actuated, the device will dispense the entire amount of fluid in the pressurized container into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
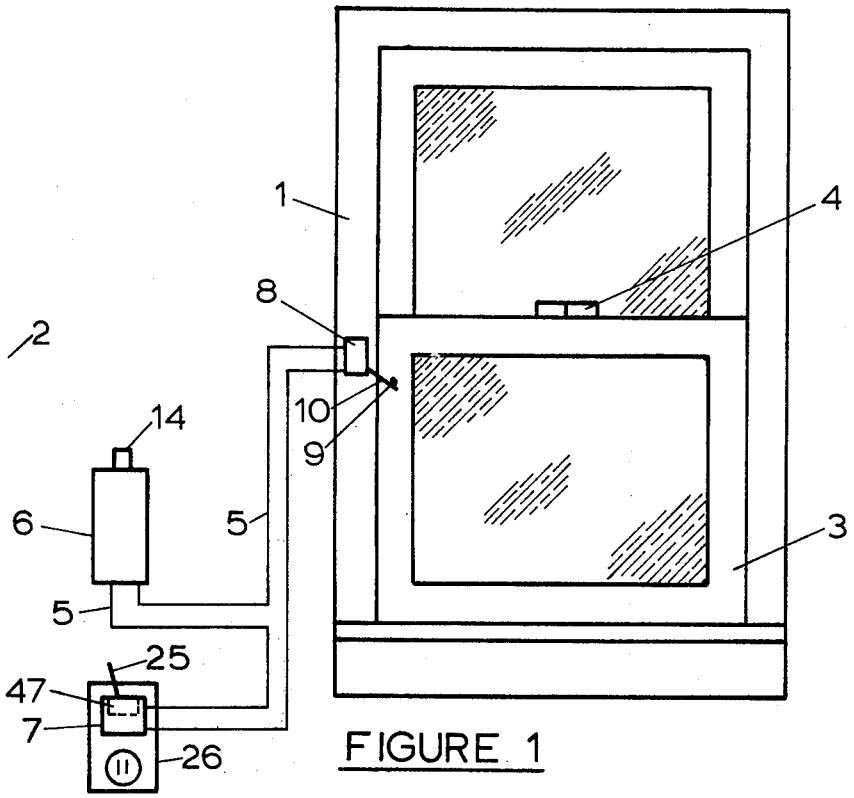
FIG. 1 is an elevational view of a wall of a room having one embodiment of the fluid dispensing anti-burglary device secured to the wall and electrically connected to a switch mounted on the frame of a window whereby the contacts of the switch are held open by the window.

Referring now to the drawings in detail, wherein like reference characters designate like parts throughout the various views, there is shown in FIGS. 1–6, one form of the fluid dispensing anti-burglar device, called device hereafter, of the chemical weapon type according to the present invention, generally designated 6. The device 6 may be installed anywhere in an area to be protected and may be connected in series to a switch and an electric power supply. One such installation is shown in FIG. 1, wherein the device 6 is fastened to a wall 2 and connected in series by means of wires 5 to a switch 8 and to an electric power supply 7. The electric power supply 7 may be of any compatible voltage and is shown for convenience as being adapted for use with the standard 110 volt alternating current wall outlet 26, available almost everywhere in the United States. The power supply may contain a switch 47 having an actuator arm 25 for turning the electric power "on" or "off".

The switch 8 is shown for convenience as being mounted on the window frame 1 so that its actuator arm 10 is controlled by pin 9 fastened to the window 3. The switch 8 is of the normally closed type wherein its contacts will close when its actuator arm 10 is released. Therefore, the pin 9 will hold the contacts of switch 8 open and no electric power can be applied to device 6.

Figure 2:
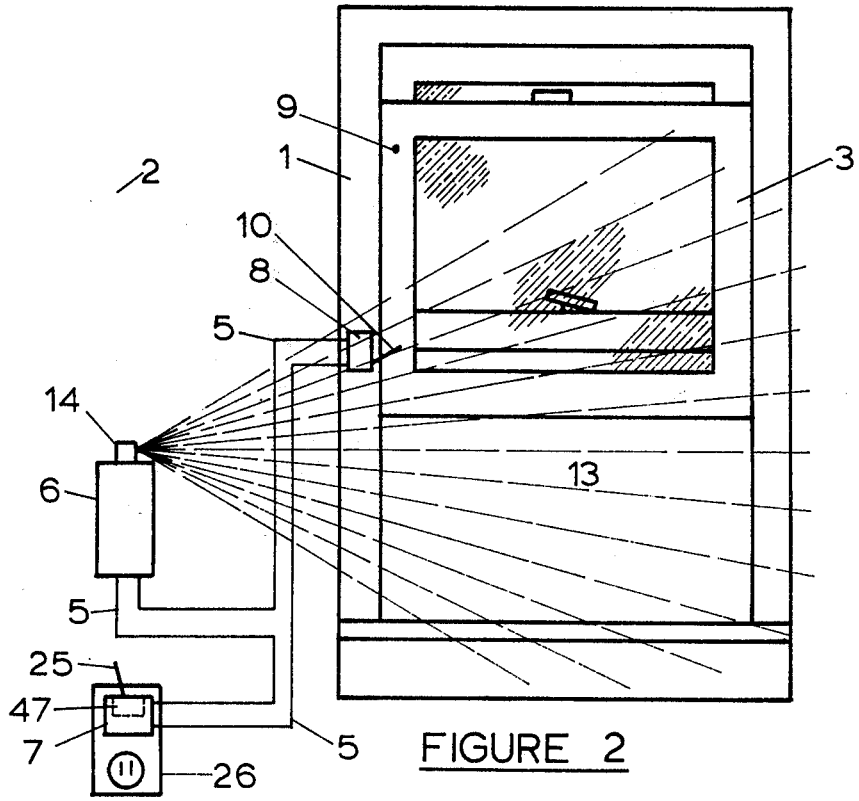
FIG. 2 is an elevational view similar to FIG. 1, but showing the window open and the device dispensing fluid.

With the actuator arm 25 of the electric power supply switch 47 in the "off" position, the window 3 may be safely opened and closed without causing the device 6 to discharge. When the actuator arm 25 is in the "on" position, opening of the window 3 will close the contacts of switch 8 and electric current will flow to the device 6. As shown in FIG. 2, the device 6 will dispense fluid 13 when electric power is supplied to it by the closing of the contacts in switch 8 upon the opening of the window 3. Although the electric power supply is shown as being supplied by an external power source and the switch 8 is mounted external of device 6, it is recognized that the switch 8 and/or electric power supply 7 in the form of electric batteries may be installed inside device 6.

Figure 3:
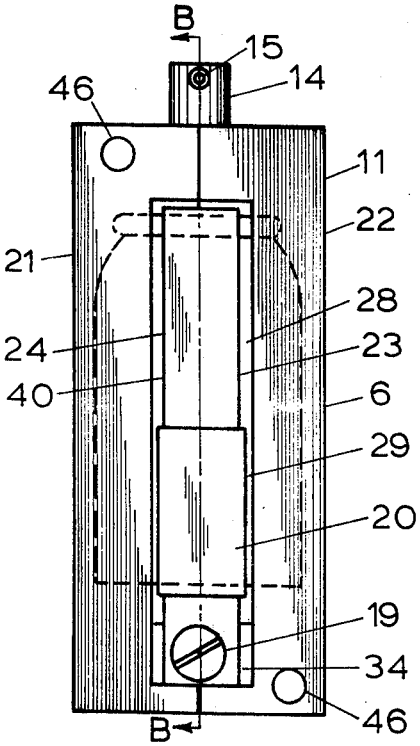
FIG. 3 is a front elevational view of the fluid dispensing anti-burglary device.

The device 6, whose front is shown in FIG. 3, comprises a pressurized container 31, called container 31 hereafter, mounted in a body member 11 shown for convenience as being comprised of a left body half 21 and a right body half 22. The two body halves 21 and 22 when assembled provide four flat sides for mounting the device 6 to the wall 2 or elsewhere. The holes 46 may be used attaching device 6 to a wall 2 or elsewhere by screws or nails.

Figure 6:
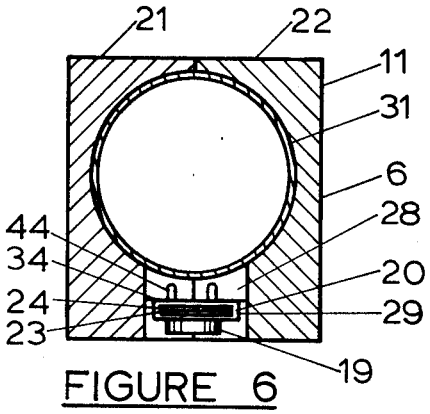
FIG. 6 is a horizontal section taken along line A—A of FIG. 3 showing the electrothermal actuator in cross section.
Figure 5:
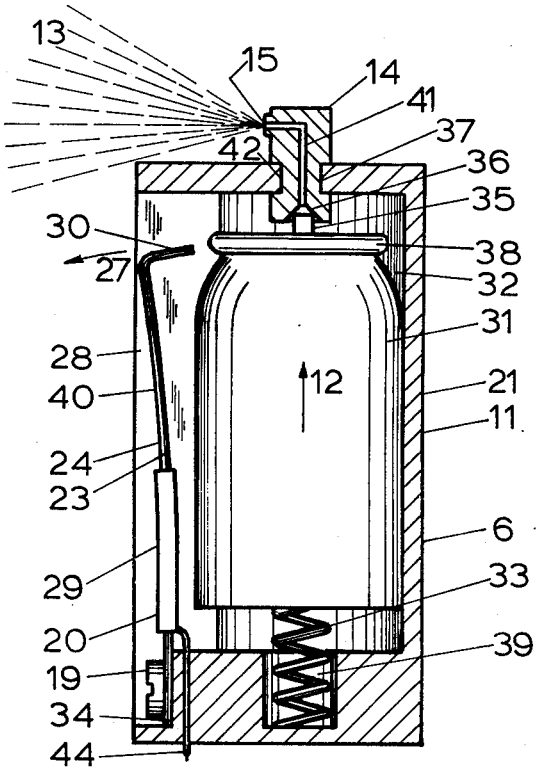
FIG. 5 is a vertical section taken along line B—B of FIG. 3 similar to FIG. 4 but shows the device dispensing fluid.
Figure 4:
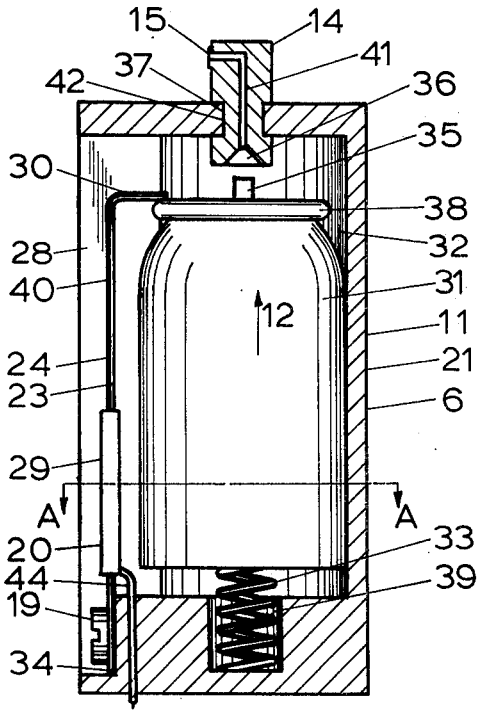
FIG. 4 is a vertical section taken along line B—B of FIG. 3 showing the spring biased elements in a cocked position and the dispensing element displaced from its actuation means.

The coaxial cylindrical bores 32, 37 and 39 as shown in FIGS. 4 and 5, are formed when the symetrically opposite body halves 21 and 22 are joined together as shown in FIGS. 3 and 6. The cylindrical bore generally designated 32 slidably mounts the container 31. The container 31 of which one type is sold by Defense Products Manufacturing Corporation, 1628 S. Hanley Rd., St. Louis, Mo. identified as their "Paralyzer" and another type is sold by Penquin Industries, Inc., Parkesburg, Pa. identified as their "10-44Chemical Billy" but the invention is not limited to the use of these containers. The container 31 includes a fluid dispensing element which comprises a spring urged projecting dispensing spout 35 which when depressed discharges a fluid 13 through the center of the projecting dispensing spout 35.

Figure 8:
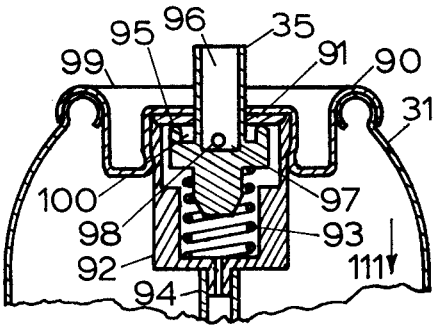
FIG. 8 is a partial vertical section showing a valve for use with the pressurized container having a projecting dispensing spout.

One type of pressurized container 31, shown as having a fluid-dispensing element in the form of a projecting dispensing spout 35, for use in this embodiment is shown in FIG. 8 as containing a valve assembly generally disignated 90. Valve assemblies of this type are well known in the trade and one type of which is sold by Scovill, Manchester, N.H. as their S-63 valve assembly. The valve assembly 90 is shown as being comprised of a projecting dispensing spout 35 which has generally a hollow tube portion 96 and is closed at one end 97 thereof. A valve seat 95 is formed around the sealed end 97 of the dispensing spout 35 and contains a recessed portion 100 formed to provide a fluid passageway which will permit fluid flow to a discharge hole 98 and gives fluid access to the hollow tube 96. The dispensing spout 35 is slidably mounted in spring cup 92 and is urged by spring 93 toward the valve seal 91. In this position, the valve seat 95 forms a seal with the valve seal 91. A dip tube 94 may be attached to the spring cup 92 to provide access to fluid when in liquid form in the bottom of the container 31. The assembly is generally mounted in a metal cup 99 which is then fastened to the container 31.

When the projecting dispensing spout 35 is moved in direction 111, the valve seat 95 is separated from the valve seal 91 thereby, permitting fluid under pressure to flow up dip tube 94, around the valve seat 95, through the discharge hole 98 and out the hollow tube 96.

Now referring to FIGS. 4 and 5; the cylindrical bore generally designated 39 is coaxial with the cylindrical bore 32 and provides a means for mounting spring 33.

The spring 33 is biased to urge the container 31 in direction 12.

Again referring to FIGS. 4 and 5, the body member 11 forms a cylindrical bore 37 and provides means for mounting a rotatable dispensing head 14. The dispensing head 14 contains a fluid passageway 41 having an entry section 36 at one end thereof for engaging with the projecting dispensing spout 35 of container 31 and a discharge section 15 on the other end. The dispensing head 14 provides a means for the fluid 13 to be discharged into and directed from when the projecting dispensing spout 35 of the container 31 is forced into the entry section 36 by the spring 33 acting to move the slidably mounted container 31 in the direction of arrow 12. The funnel shape of the entry section 36 engages the projecting dispensing spout 35, which is made of a relatively soft material and therefore provides an adequate seal at the entry section 36 to retain fluid flow in the passageway 41 at pressures normally used in the container 31.

Figure 7:
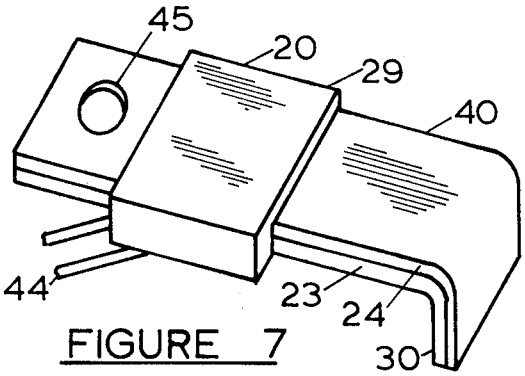
FIG. 7 is an elevational view of the electrothermal actuator.

The container 31, in the position illustrated in FIG. 4, is in its cocked position where the spring 33 is compressed and the spout 35 is coaxial but displaced from the entry section 36. The container 31 is releasably restrained in a cocked position by an electrothermal actuator. The electrothermal actuator, generally designated actuator 20 can be best seen in FIG. 7. The actuator 20 is comprised of a bimetal strip 40 made of two dissimilar metals attached together by welding, bonding or similar process. By using a material which has a high coefficient of expansion such as brass ($\alpha = 19 \times 10^{-6}/°$ C) for the strip 23 closest to the container 31 and a material which has a low coefficient of expansion such as steel ($\alpha = 12 \times 10^{-6}/°$ C) for the other strip 24; the resulting bimetal strip 40 will bend away from container 31 upon the application of heat (increase in temperature). A means for converting the applied electric power into heat is provided by a resistance heater 29 which can be in the form of an electric coil or a resistance grid mounted, bonded or attached to the bimetal strip 40.

Now referring to FIGS. 4 and 5, a shaped latch portion 30 of the bimetal strip 40 is provided for engaging with the rim 38 of the container 31. For simplicity, the shaped latch portion 30 for engaging the container 31 is illustrated as being a bent section of the bimetal strip 40. It should be understood that the shaped latch portion 30 should be of sufficient rigidity to resist deforming under the pressure of spring 33 in order to prevent the release of the container 31.

The bimetal strip 40 is mounted in a slot 28 formed in body halves 21 and 22 and held in position by screw 19 as can best be seen in FIGS. 3, 4 and 5.

Again referring to FIGS. 4 and 5, as electric power is applied to the actuator 20, the resistance heater 29 heats the bimetal strip 40, whereby the resulting difference in coefficients of expansion between the different materials will cause the bimetal strip 40 to bend in the direction of arrow 27. Continued bending of the bimetal strip 40 will move the shaped latch portion 30 from engagement with container 31; thereby permitting the container 31 to move in direction 12. The spring 31 will then move the container 31 toward the funnel shaped entry section 36. The fluid-dispensing element in the form of a projecting dispensing spout 35 engages with the dispensing element actuating means in the form of a funnel shaped entry section 36 of the passageway 41 and thereby causes fluid discharge as the projecting spout 35 is depressed.

After the device has been discharged in the manner described herein above, the body halves can be separated to replace the container 31, after disconnecting the electric power as shown in FIG. 4.

It is an important feature that the shaped latch portion 30 of actuator 20 prevent a surface which will slide smoothly on the rim 38 of the container 31 when the actuator 20 is energized. As a consequence the actuator 20 may be easily withdrawn from engagement without substantial force. Yet when the actuator 20 is positioned in engagement with the rim 38 of the container 31, the actuator 20 serves to positively retain container 31 in its cocked position.

Yet another important feature is that the dispensing head 14 is rotatable in socket hole 37 through a large angle up to 360° so that the fluid 13 may be directed into any area relative to the triggering object.

Another important feature is that the spring 33 be of substantial force so that the projecting dispensing spout 35 will seat in the entry section 36 with sufficient force to release the pressurized fluid through the passageway 41 and out the dispensing head 14.

If it is desired to utilize the fluid dispensing anti-burglar device again, it is reset as illustrated in FIG. 1. If it is desired to render it temporarily inoperative, the actuator arm 25 on power supply 7 is moved to the "off" position.

Security from accidental release is achieved by keeping the actuator 20 recessed from the exterior surface of the body halves 21 and 22. By mounting the actuator 20 in the body halves 21 and 22 in this manner, there is no surface of the actuator 20 exposed to grip and therefore cannot be released.

It is also important in this embodiment that the fluid-dispensing element comprises a dispensing valve 90 having a projecting dispensing spout 35 which when depressed causes fluid discharge therethrough. The fluid passageway 41 contains the fluid dispensing element actuating means in the form of a funnel shaped entry section 36 which engages the projecting dispensing spout 35 and forms a seal between the entry section 36 of passageway 41 and the projecting dispensing spout 35.

Although the device 6 is shown as having the fluid passageway 41 contained in a rotatable dispensing head; the passageway may also be formed in the body member 11.

Figure 9:
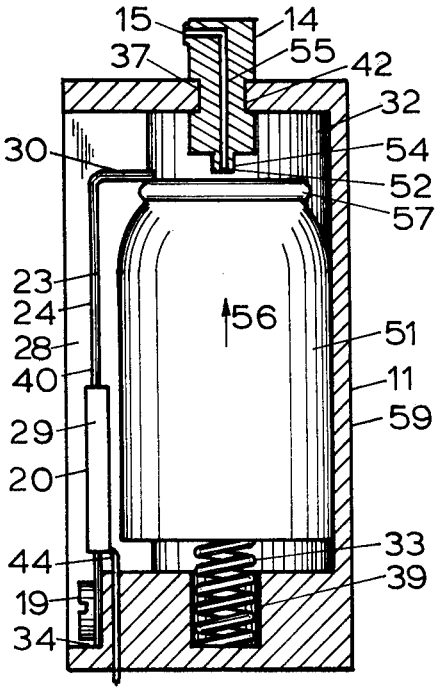
FIG. 9 is a vertical section similar to FIG. 4 but showing a second embodiment of the anti-burglary device containing a pressurized container of the aerosol type but having a recessed valve.

A second embodiment of the invention is illustrated in FIG. 9. In this embodiment the basic structure is as previously described and like numbers are used to indicate like or corresponding parts.

In this embodiment, the pressurized fluid container 31, shown in FIG. 4 having a projecting dispensing spout 35, is replaced with a pressurized fluid container 51, shown in FIG. 9, having a recessed valve. Pressurized containers with a recessed dispensing valve are will known in the trade. In addition, the funnel shape of the entry section 36 of the fluid passageway 41 of the first embodiment shown in FIG. 4 is replaced with projecting spout 54 depending from dispensing head 14, all of which are shown in FIG. 9.

In this embodiment, all elements function as described in the first embodiment with the following difference. The pressurized container 51 is discharged by the action of spring 33 moving the pressurized container 51 such that the recessed valve of the pressurized container 51 is depressed through engagement with projecting spout 54 and thereby effects discharge.

Figure 10:
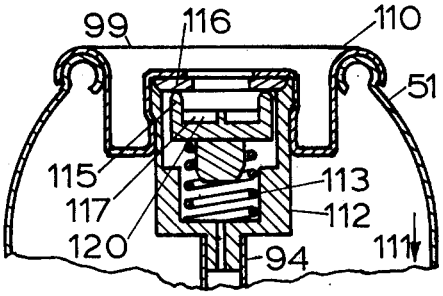
FIG. 10 is a partial vertical section showing a valve for use with a pressurized container having a recessed valve.

One type of recessed valve for use in this embodiment is shown in FIG. 10 and is generally designated 110. Valve assemblies of this type are well known in the trade and one type of which is sold by Scovill, Manchester, N.H. The valve assembly 110 is shown as being comprised of a valve seat 115 mounted in a spring cup 112. The valve seat 115 contains a recessed portion 120 and recessed channels 117 formed in valve seat 115.

The valve seat 115 is slidably mounted in spring cup 112 and is urged by spring 113 toward valve seal 116. In this position, the valve seat 115 forms a seal with the valve seal 116. The valve assembly 110 is generally mounted in a metal cup 99 which is then fastened to the pressurized container 51.

When the device 6 is actuated, the valve assembly 110 is moved along with the pressurized container 51 in the direction 56. As movement continues, the projection spout 54 of the dispensing head 14 engages with and moves the valve seat 115 from engagement with valve seal 116 permitting fluid under pressure to flow around the valve seat 115, through the discharge channels 117 and out passageway 55. When the projecting spout 54 entered the valve assembly 110, the valve seal 116, being made of resilient material, formed a seal between the circumference of the projecting spout 54 and the valve seal 116, thus preventing fluid leakage.

The fluid 13 is then discharged through the valve 110 of the pressurized container 51, through the entry section 52 and passageway 55 and out the dispensing head 14, then into the area to be protected.

As shown in FIG. 9, when electric power is applied to the heater 29 of the actuator 20, the heater 29 applies heat to the bimetal strip 40. This causes the shaped latch portion 30 to be moved from container rim 57 and permits the container 51 to be moved in direction 56, causing discharge through the action of the projection dispensing spout 54 acting on the recessed valve 110 of container 51. The fluid 13 will then be forced up through passageway 55 and disperced through orifice 15.

It is important in this embodiment that the fluid-dispensing element comprises a recessed valve assembly 110 which when depressed causes fluid discharge. It is also important that the entry section 52 of passageway 55 contain a fluid dispensing element actuating means in the form of a projecting spout 54 which engages with the recessed valve assembly 110 and causes fluid discharge.

Figure 11:
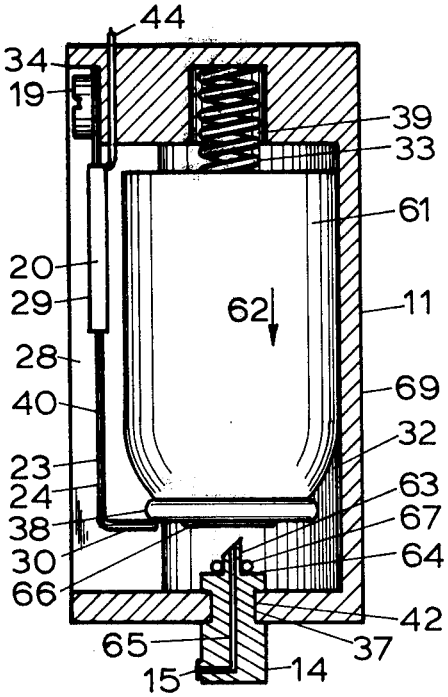
FIG. 11 is a vertical section similar to FIG. 4 but showing a third embodiment of the anti-burglary device containing a pressurized container of the type with a pierceable seal and a means for piercing the seal.

A third embodiment of the invention is illustrated in FIG. 11. In this embodiment the structure is as previously described in the first embodiment and like numbers are used to indicate like or corresponding parts.

In this embodiment, the pressurized fluid container 31, shown in FIG. 4 of the first embodiment and having a projecting dispensing spout 35, is replaced with a pressurized fluid container 61 shown in FIG. 8, having a pierceable seal 66. Pressurized containers having pierceable seals are well known in the trade. In addition, the funnel shaped entry section 36 of the body halves 21 and 22 of the first embodiment shown in FIG. 4 is replaced with body halves 68 and 69 having a projecting section 63 shaped to pierce seal 66 and a means of making a seal capable of withstanding the pressure required for effectively discharging fluid through the passageway 65 and into the restricted area.

Now referring to FIG. 11, FIG. 11 is an inverted embodiment of FIG. 4 of the first embodiment in which all elements function as described in the first embodiment with the following exceptions. The pressurized cylinder 61, when released by the actuator 20, is forced by spring 33 into pierceable engagement with the piercing projecting section 63. As the pierceable seal 66 is pierced by the action of the projecting forward section 63, the spring 33 continues to move the container 61, forming a seal by the action of the O-Ring 67 and its retaining seat 64 and the pierceable seal 66 of the pressurized container 61. The fluid 13 is then discharged through the pierced seal 66 of the pressurized container 61, through passageway 65, out the orifice 15, and then into the area to be protected.

It is important in this embodiment that the fluid-dispensing element comprises a pierceable seal 66 which when pierced will permit fluid discharge therethrough. It is also important that the dispensing element actuating means comprises a projecting piercing section 63 set in a position to pierce the pierceable seal 66 when the pressurized container 61 is moved toward it. It is also important that a seal be made around the projecting piercing section 63 to prevent fluid leakage within the body member 11 after the pierceable seal 66 is pierced.

Figure 12:
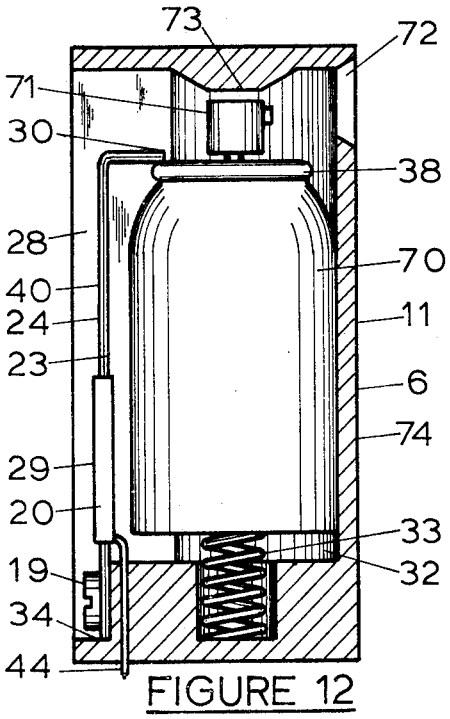
FIG. 12 is a vertical section similar to FIG. 4 but showing a fourth embodiment of the fluid dispensing anti-burglary device containing a pressurized container of the aerosol type with a projecting dispensing cap.
Figure 13:
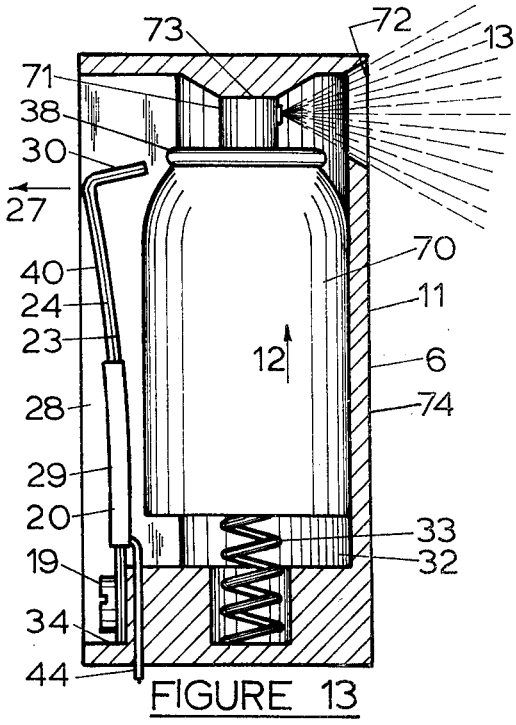
FIG. 13 is a vertical section similar to FIG. 12 but showing the spring biased element in its released position after the device has been actuated.

A fourth embodiment of the invention is illustrated in FIGS. 12 and 13. In this embodiment, the structure is as previously described in the first embodiment and like numbers are used to indicate like or corresponding parts.

In this embodiment, the projecting dispensing spout 35 of pressurized fluid container 31, shown in FIG. 4, is replaced with a projecting dispensing cap 71 shown in FIGS. 12 and 13. In addition, the fluid passageway 41 and the entry section 36 are replaced with an aperture 72.

Now referring to FIG. 12 and FIG. 13, the actuator 20 and the spring 33 operate as before to move the container 31. In this embodiment, the spring 33 urged container 31 causes the projecting cap 71 to be depressed against the inside top portion 73 of body halves 74 and 75; therby causing discharge through aperture 72.

It is important in this embodiment that the fluid-dispensing element comprises a projecting dispensing cap 71 which when depressed causes fluid discharge therethrough. The body member 11 contains an aperture 72 in communication with the projecting dispensing cap 71 to provide for fluid discharge from the body member 11. A dispensing element actuating means is provided by the surface 73 which will depress the dispensing cap 71 when the container 31 is moved toward it and thereby cause fluid discharge.

Figure 14:
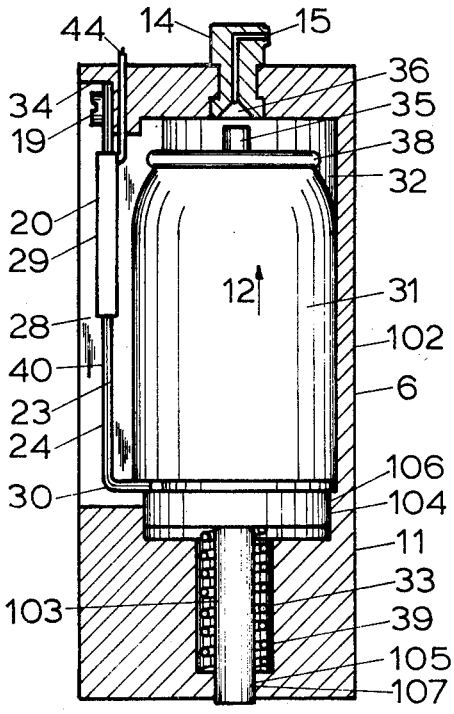
FIG. 14 is a vertical sectional similar to FIG. 4 but showing a fifth embodiment containing an electrothermal actuator engaging spring biased element which causes movement of the pressurized container.

A fifth embodiment of the invention is illustrated in FIG. 14. In this embodiment, the basic structure is as previously described in the first embodiment and like numbers are used to indicate like or corresponding parts.

In this embodiment, the actuator 20 of the first embodiment is made to work on a biased actuating member 103. The actuator 20 operates in the manner previously described.

The actuator 20 and body member 11 of the first embodiment is modified to provide a means for the actuator 20 to retain a biased actuating member 103 in a cocked position. The biased actuating member 103, one type of which is shown as having two cylindrical portions 106 and 107. The body member 102 contains coaxial bores 104 and 105 to slidably mount the biased actuating member 103. A spring 33 is mounted in its spring cavity 39 and urges the biased actuating member 103 in the direction of 12.

When electric power is applied, the actuator 20 moves its shaped latch portion from engagement with the biased actuating member 103. The spring 33 urges the biased actuating member 103 in the direction of 12. The device 117 will then discharge as previously described.

Figure 15:
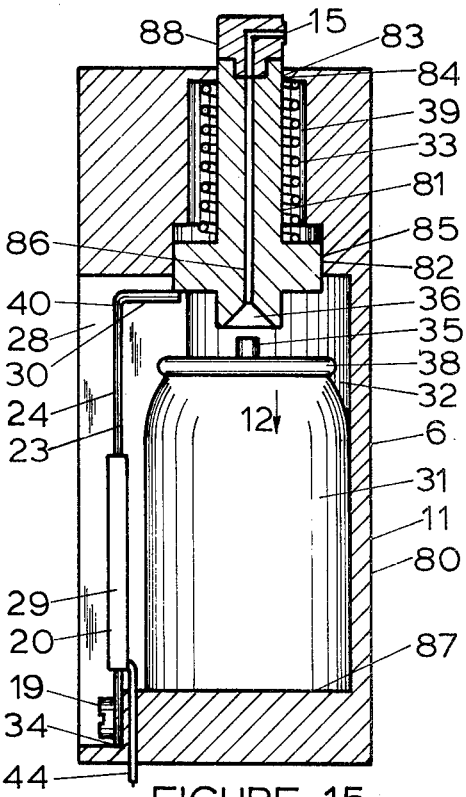
FIG. 15 is a vertical section similar to FIG. 4 but showing a sixth embodiment containing an electromechanical actuator engaging a spring biased element for direct application of force on the dispensing element of the pressurized container.

A sixth embodiment of the invention is illustrated in FIG. 15. In this embodiment, the basic structure is as previously described in the fifth embodiment and like numbers are used to indicate like or corresponding parts.

In the anti-burglary device previously described, the actuator 20 holds the biased actuating member 103 in a cocked position. In this embodiment, the actuator 20 releasably retaining a biased actuating member 81. The spring 33 urged biased actuating member 81 is shown as having two cylindrical portions 82 and 83. The body member 11 contains coaxial bores 84 and 85 to slidably mount the biased actuating member 81. A spring 33 is mounted in the spring cavity 39 and urges the biased actuating member 81 in the direction 12.

When electric power is applied to the electrothermal actuator 20; the shaped latch portion 30 is moved away from engagement with biased actuating member 81. This permits the spring 33 urged biased actuating member 81 to be moved in the direction of arrow 12 until the projecting dispensing spout 35 of the pressurized container 31 is in seated engagement with the entry section 36; further movement of the biased actuating member 81 will depress the projecting dispensing spout 35 and cause the fluid 13 to be released from the pressurized container 31; through the dispensing spout 35, the entry section 36, the fluid passageway 86 and the orifice 15 in dispensing head 88.

The chemical dispensing anti-burglary device described herein in several embodiments was generally shown with a pressurized container 31 with a projecting dispensing spout 35 mounted to discharge into a funnel shaped entry section 36 of a fluid passageway 41 when the device is discharged. Alternately the device will also function with a pressurized container with a recessed valve by providing a tubular member depending from the body member to cause discharge; in addition the devices can be used with a sealed pressurized container with a pierceable seal; also the pressurized container with a dispensing projecting cap wherein the projecting cap is depressed to cause discharge; but the invention is not limited to these type of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A fluid dispensing anti-burglar device for use with a pressurized container, the device comprising:

a. a body member;

b. means for supporting said pressurized container in said body member, wherein said pressurized container has a fluid-dispensing element adapted to release fluid under pressure from said pressurized container when actuated;

c. dispensing element actuating means mounted in said body member and adapted to engage and actuate said fluid-dispensing element;

d. a passageway in said dispensing element actuating means having an entry section at one end thereof;

e. spring means biased to force said fluid-dispensing element and said dispensing element actuating means into engagement with each other, thereby causing said fluid-dispensing element to be actuated;

f. an electrothermal actuator releasably retaining said spring means in a cocked position in which said fluid-dispensing element and said dispensing element actuating means are separated from each other, said electrothermal actuator releasing said spring means from its cocked position upon the application of electric current causing said fluid-dispensing element to be actuated, whereby fluid under pressure is released from said container to pass through said entry section and passageway.

2. The fluid dispensing anti-burglar device of claim 1 in which said fluid-dispensing element of the pressurized container comprises a pierceable section, and said dispensing element actuating means comprises means to provide a seal between said pierceable section and said entry section, and means for puncturing said pierceable section, whereby fluid may be discharged.

3. The fluid dispensing anti-burglar device of claim 2 in which said means for puncturing comprises a projecting spout depending from said dispensing element actuating means.

4. The fluid dispensing anti-burglar device of claim 1 wherein said fluid-dispensing element of said pressurized container includes a dispensing valve actuated to permit fluid discharge therethrough upon depression thereof, said valve being actuated to the depressed position through movement caused by the release of said spring means whereby the valve is depressed and fluid is discharged.

5. The fluid dispensing anti-burglar device of claim 4 wherein said valved pressurized container contains a projecting dispensing spout, said dispensing spout discharging fluid upon depression thereof, said entry section of said passageway being funnel shaped for receiving said projecting dispensing spout on said container.

6. The fluid dispensing anti-burglar device of claim 4 wherein said valved pressurized container includes a recessed valve, said dispensing element actuating means includes a projection around said entry section extending toward said container to engage said recessed valve, said recessed valve actuated upon depression thereof to emit fluid.

7. The fluid dispensing anti-burglar device of claim 4 wherein said valved pressurized container contains a projecting dispensing cap actuated to permit fluid discharge therethrough upon depression thereof, an aperture in said body member in communication with said cap, said spring means arranged to actuate said dispensing cap upon release thereby discharging said pressurized container through said cap and aperture when said spring means is released.

8. The fluid dispensing anti-burglar device of claim 1 wherein the spring means biases the actuating member to actuate said fluid-dispensing element after release.

9. The fluid dispensing anti-burglar device of claim 1 wherein said pressurized container is slidably supported in said body member and spring biased toward said dispensing element actuating means, said electrothermal actuator in a holding position arranged to engage and hold said pressurized container in a cocked position in which the fluid-dispensing element of said pressurized container is displaced from said dispensing element actuating means, said electrothermal actuator in a release position permitting said fluid-dispensing element of said spring biased pressurized container to be moved into engagement with the dispensing element actuating means to cause fluid discharge.

10. The fluid dispensing anti-burglar device of claim 1 wherein said pressurized container is slidably supported in said body member, the spring means biases the actuating member slidably supported in said body member and arranged to move said slidably supported pressurized container toward said dispensing element actuating means, said electrothermal actuator in a holding position arranged to engage and hold said biased actuating member in a cocked position in which said pressurized container is displaced from the biased actuating member, said electrothermal actuator in a release position permitting said spring biased actuating member to move said fluid-dispensing element of said pressurized container into engagement with said dispensing element actuating means, thereby causing fluid discharge.

11. The fluid dispensing anti-burglar device of claim 1 wherein the spring means biases the actuating member containing said dispensing element actuating means and arranged for movement in said body member, said electrothermal actuator in a holding position arranged to engage and hold said spring biased actuating member in a cocked position in which said dispensing element actuating means is displaced from said fluid-dispensing element, said electrothermal actuator in a release position permitting said spring biased actuation member to be moved toward said pressurized container such that said dispensing element actuating means engages with said fluid-dispensing element, thereby causing fluid discharge.

12. The fluid dispensing anti-burglar device of claim 1 wherein said electrothermal actuator is comprised of a heating means and a bimetal strip, said heating means arranged to heat said bimetal strip whereby said bimetal strip releases said spring means.

13. The fluid dispensing anti-burglar device of claim 1 wherein said electrothermal actuator is comprised of a heating element attached to a bimetal strip, said heating element arranged to heat said bimetal strip upon the application of an electric current whereby said bimetal strip releases said spring means.

14. The fluid dispensing anti-burglar device of claim 1 wherein said electrothermal actuator is comprised of an electric resistance heating element and a bimetal strip having a shaped latch portion for engaging with said spring means, said resistance heating element arranged to heat said bimetal strip upon the application of an electric current whereby said bimetal strip releases said spring means.

* * * * *